US007307505B2

(12) United States Patent
Yu

(10) Patent No.: US 7,307,505 B2
(45) Date of Patent: Dec. 11, 2007

(54) SAFETY SWITCHES

(76) Inventor: Tsung-Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 350 days.

(21) Appl. No.: 11/185,455

(22) Filed: Jul. 20, 2005

(65) Prior Publication Data

US 2007/0018772 A1 Jan. 25, 2007

(51) Int. Cl.
*H01H 61/02* (2006.01)
*H01H 71/16* (2006.01)

(52) U.S. Cl. ..... 337/66; 337/59; 337/62; 337/72

(58) Field of Classification Search ..... 337/62, 337/66, 59, 72; 200/314, 341, 345
See application file for complete search history.

(56) References Cited

U.S. PATENT DOCUMENTS 3,564,174 A * 2/1971 Clarke ..... 337/52
3,629,762 A * 12/1971 Walling ..... 337/62
3,792,403 A * 2/1974 Bullock ..... 337/66
3,975,702 A * 8/1976 Carpenter ..... 337/62
3,990,028 A * 11/1976 Aust et al. ..... 337/46
4,024,487 A * 5/1977 Krasser et al. ..... 337/46
4,255,629 A * 3/1981 Bell ..... 200/61.45 R
4,342,979 A * 8/1982 Phillips ..... 337/41
4,400,677 A * 8/1983 Cobb et al. ..... 337/6
4,780,697 A * 10/1988 Cobb et al. ..... 337/70
4,812,799 A * 3/1989 Cobb et al. ..... 337/70
4,837,545 A * 6/1989 Cobb et al. ..... 337/66
4,939,495 A * 7/1990 Peterson et al. ..... 337/79
5,157,369 A * 10/1992 Yao ..... 337/68
5,459,446 A * 10/1995 Vidal et al. ..... 337/188
5,854,585 A * 12/1998 Kingma ..... 337/367
6,229,426 B1 * 5/2001 Lavado et al. ..... 337/57
6,353,526 B1 * 3/2002 Pellon ..... 361/115
6,448,880 B2 * 9/2002 Yu ..... 337/66
6,522,228 B2 * 2/2003 Wellner et al. ..... 335/18
6,617,952 B1 * 9/2003 Yu ..... 337/94
6,642,832 B2 * 11/2003 Pellon et al. ..... 337/66
6,710,695 B1 * 3/2004 Pellon et al. ..... 337/66
6,900,405 B2 * 5/2005 Abraham et al. ..... 200/538
7,064,636 B1 * 6/2006 Walz et al. ..... 335/18
2002/0080003 A1 * 6/2002 Pellon et al. ..... 337/55
2002/0125981 A1 * 9/2002 Yu ..... 337/367
2002/0153990 A1 * 10/2002 Yu ..... 337/333

FOREIGN PATENT DOCUMENTS

DE 3313465 A * 10/1984

* cited by examiner

*Primary Examiner*—Anatoly Vortman

(57) ABSTRACT

A switch includes a push rod which extends from an underside of a switch member and the push rod selectively pivots an action member in "ON" and "OFF" positions. A bi-metallic contact plate has a first end fixed to one of two terminals and a contact portion splits from the contact plate. A first contact point is connected to an underside of the contact portion so as to contact a second contact point on the other terminal when in "ON" position. A free end of the contact portion is connected with a free end of a spring member which is fixed on the contact plate. There is a sufficient space for the upward movement of the action member when overloaded.

9 Claims, 5 Drawing Sheets

(OFF)

(ON)

(ON)

(OFF)

SAFETY SWITCHES

BACKGROUND OF THE INVENTION

1. Field of the Invention

The present invention relates to a safety switch that ensures the bi-metallic plate to be deformed as desired when overloaded.

2. The Prior Arts

A conventional switch device, especially those switches using bi-metallic plate to prevent from being burned when an overloaded happens, generally includes a bi-metallic plate which is deformed when overloaded so as to separate the two contact points respectively located on the bi-metallic plate and one of the two terminals. Some inherent shortcomings for these conventional safety switches are found. There are too many parts involved in the safety switches and a longer period of time is required when assembling the switches, so this increases the cost of the products. The parts might be arranged inaccurately and this would affect the deformation of the bi-metallic plate. Once the bi-metallic plate is deformed to cut off the circuit, because of the improper arrangement of the parts as mentioned above, the bi-metallic plate could deform to re-connect the two contact points to connect the circuit again. Because of the inaccuracy of the deformation of the bi-metallic plate, the switch member does not set to the "OFF" position after the bi-metallic plate is deformed to cut off the circuit.

Therefore, it is desired to have a safety switch that allows the bi-metallic plate to deform toward a desired direction and has enough space for the deformation of the bi-metallic plate to prevent the bi-metallic plate from bouncing back to connect the circuit again.

SUMMARY OF THE INVENTION

In accordance with an aspect of the present invention, there is provided a switch that comprises a body and a switch member that is engaged with a top opening of the body. The switch member is moved in a vertical direction relative to the body. A first terminal and a second terminal extend through a bottom of the body. Two resilient members are connected between an inside of the body and the switch member to maintain the switch member at an upper position.

A link mechanism has a push rod and an action member which is pivotably connected to the body. A spring is mounted to the push rod and a first end of the push rod is movably engaged with the switch member. The action member has a left slope surface and a right slope surface, and a second end of the push rod selectively contacts the two slop surfaces when the switch member is pushed. An extension extends inclinedly from a first end of the action member. When the switch member is pushed downward, the second end of the push rod pushes either of the two slope surfaces to pivot the action member.

A contact plate has a first end fixed to the first terminal and a second end of the contact plate is a free end. A contact portion splits from the contact plate and a first contact point is connected to an underside of the contact portion. A free end of the contact portion is located above a top surface of the contact plate and connected with a free first end of a spring member. A second end of the spring member is connected to the contact plate. A second contact point is connected to the second terminal and located beneath the first contact point on the contact portion. The second end of the contact plate and the free end of the contact portion are deformed in opposite directions when being heated.

The second end of the push rod is lowered to push either of the slope surfaces of the action member which is then pivoted to connect or separate the first and second contact points. When overloaded, the contact portion is bent upward to separate the two contact points and there is a sufficient space for the upward movement of the action member.

The main object of the present invention is to provide a safety switch which provides a sufficient space for movement of the action member so that the contact plate is deformed completely to cut off the circuit.

Another object of the present invention is to provide a safety switch wherein the safety switch is moved to "OFF" position when overloaded.

Yet another object of the present invention is to provide a safety switch that includes less number of parts so as to have lower manufacturing cost.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
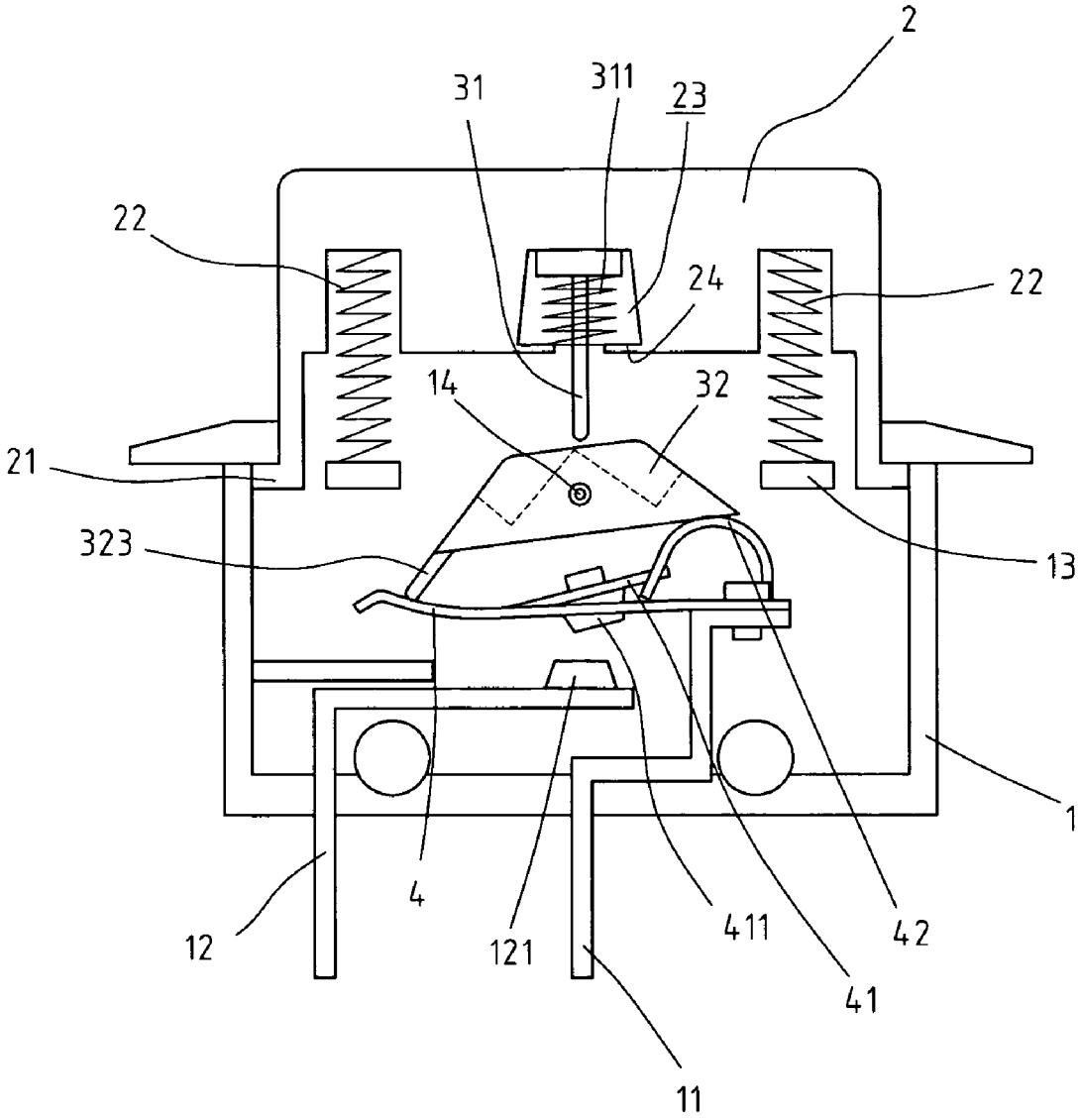
FIG. 1 is a sectional view showing the "OFF" status of a safety switch in accordance with the present invention.
Figure 5:
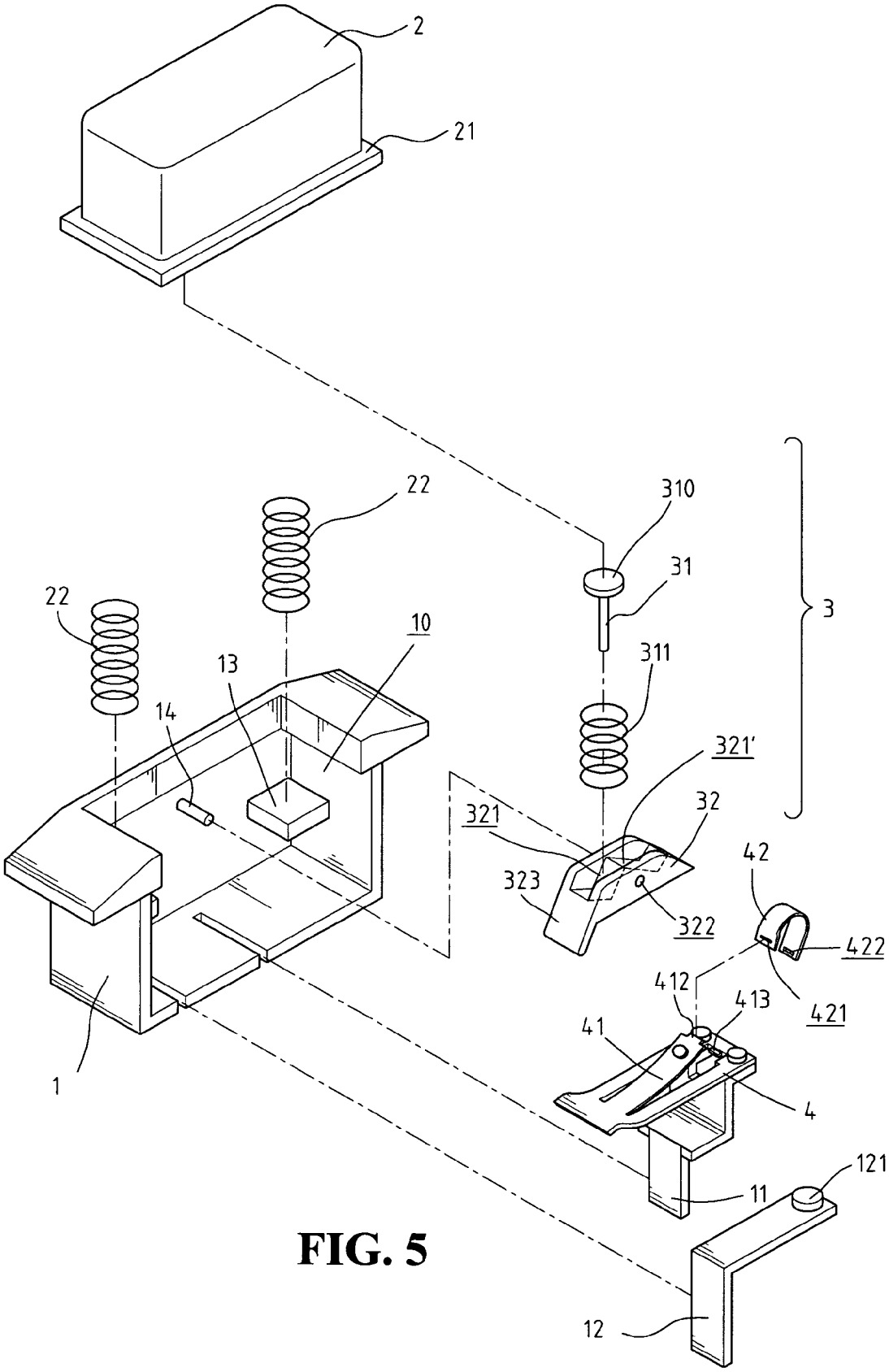
FIG. 5 is an exploded view of the safety switch in accordance with the present invention.

Referring to the drawings and in particular to FIGS. 1 and 5, a safety switch in accordance with the present invention comprises a body 1, a switch member 2, a link mechanism 3, and a contact plate 4. The body 1 has a top opening 10. The switch member 2 is engaged with the top opening 10 of the body 1. The switch member 2 has a peripheral flange 21 that limits the switch member 2 from dropping out of the top opening 10 of the body 1. Two blocks 13 extend from an inside of the body 1 and two resilient members 22 such as helical springs are connected to an underside of the switch member 2. Two respective first ends of the two resilient members 22 are stopped on the blocks 13 and the other two respective ends of the resilient members 22 are engaged with recesses 23 defined in the underside of the switch member 2. Therefore, the switch member 2 is moved in a vertical direction relative to the body 1. The two resilient members 22 maintain the switch member 2 at an upper position. A first terminal 11 and a second terminal 12 extend through a bottom of the body 1. A recess 23 is defined in an underside of the switch member 2 and two stop plates 24 extend from two facing insides of the recesses 23.

Figure 2:
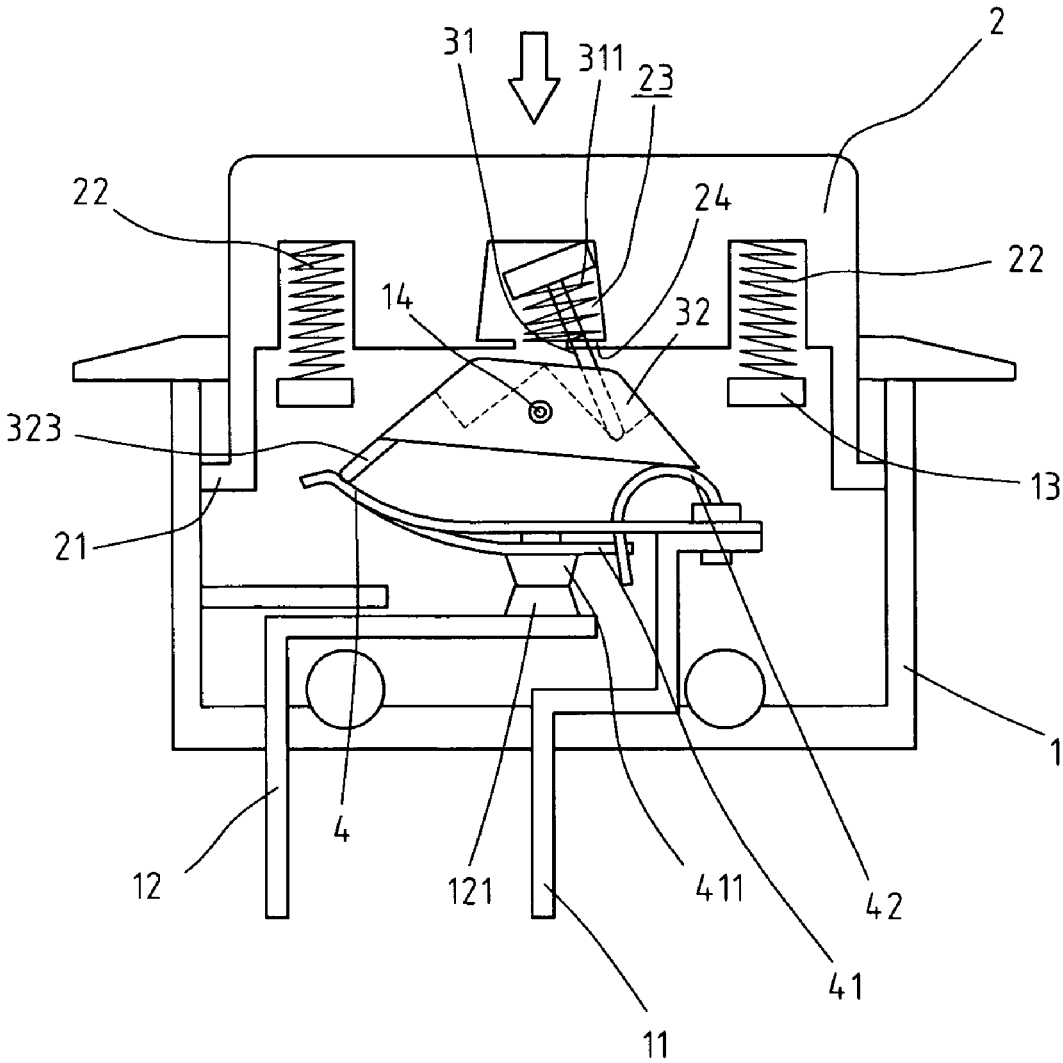
FIG. 2 is a sectional view showing that a switch member is pushed to set the safety switch to "ON" status in accordance with the present invention.
Figure 4:
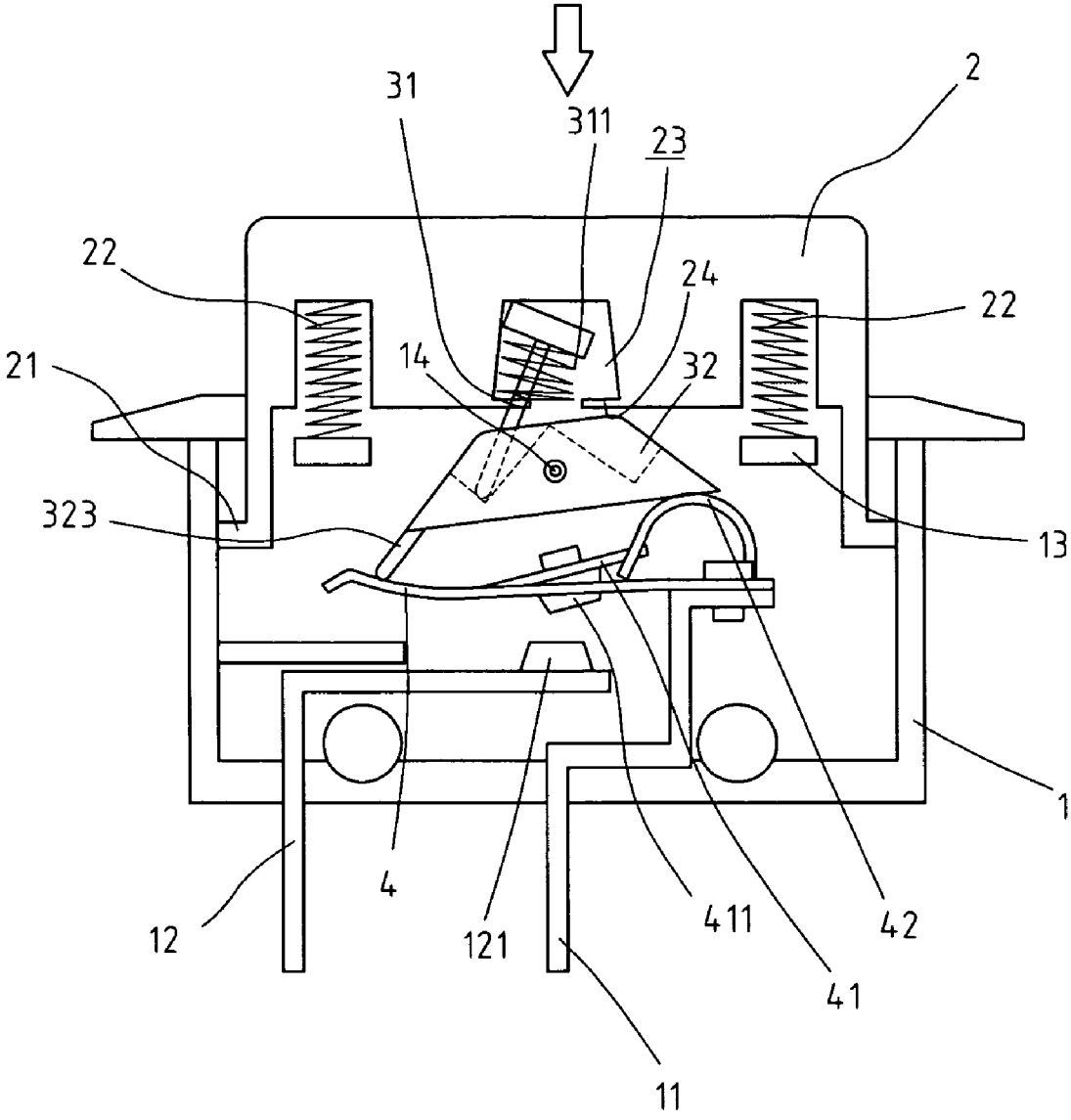
FIG. 4 shows that the switch member is pushed again to set the switch to "OFF" status.

The link mechanism 3 includes a push rod 31 and an action member 32. The first end of the push rod 31 includes a flange 310 and is movably engaged with the recess 23 in the switch member 2. A spring 311 which can be a helical spring has one end contacting the flange 310 and the other end of the spring 311 is rested on the two stop plates 24. The second end of the push rod 31 extends out from the recess 23, so that the first end of the push rod 31 is freely movable in the recess 23. The action member 32 includes a hole 322 through which a pin 14 extending from the inside of the body 1 extends, so that the action member 32 is pivotably connected to the body 1. The action member 32 has an open top in which a left slope surface 321 and a right slope surface 321' are defined. The second end of the push rod 31 selectively contacts the two slope surfaces 321, 321' when the switch member 2 is pushed as shown in FIGS. 2 and 4. An extension 323 extends inclinedly from a first end of the action member 32. When the switch member 2 is not pushed downward, the second end of the push rod 31 does not contact the two slope surfaces 321, 321' as shown in FIG. 1. When the switch member 2 is pushed downward, the second end of the push rod 31 pushes either of the two slope surfaces 321 to pivot the action member 32.

The contact plate 4 is a curve flexible bi-metallic plate and has a first end fixed to the first terminal 11 and a second end of the contact plate 4 is a free end. A contact portion 41 splits from the contact plate 4 and a first contact point 411 is connected to an underside of the contact portion 41. A free end of the contact portion 41 is located above a top surface of the contact plate 4 and connected with a first end of a U-shaped spring member 42. The free end of the contact portion 41 has a tongue 412 and the free first end of the spring member 42 has a first slot 421 with which the tongue 412 is engaged. The second end of the spring member 42 has a second slot 422 and a ridge 413 extends from an inner periphery of an opening from which the contact portion 41 splits. The ridge 413 is engaged with the second slot 422. A second contact point 121 is connected to the second terminal 12 and located beneath the first contact point 411 on the contact portion 41. It is noted that the second end of the contact plate 4 and the free end of the contact portion 41 are deformed in opposite directions when being heated. The extension 323 of the action member 32 contacts the second end of the contact plate 4 when the switch member 2 is not pushed downward, and the second end of the action member 32 contacts the spring member 42.

Referring to FIG. 2, when pushing the switch member 2 to lower the push rod 31 to push the right slope surface 321', the second end of the action member 32 is lowered to push both of the spring member 42 and the free end of the contact portion 41 downward so that the first and second contact points 411 and 121 are in contact with each other to set the switch in "ON" status. The switch member 2 bounces upward by the resilient members 22 after the user releases the switch member 2 as shown in FIG. 3.

Referring to FIG. 4, when pushing the switch member 2 to lower the push rod 31 to push the left slope surface 321, the extension 323 on the first end of the action member 32 is lowered to push the second end of the contact plate 4 downward so that the free end of the contact portion 41 is bent upward to separate the first and second contact points 411 and 121 to set the switch in "OFF" status. The switch member 2 bounces upward by the resilient members 22 after the user releases the switch member 2 as shown in FIG. 1.

Figure 3:
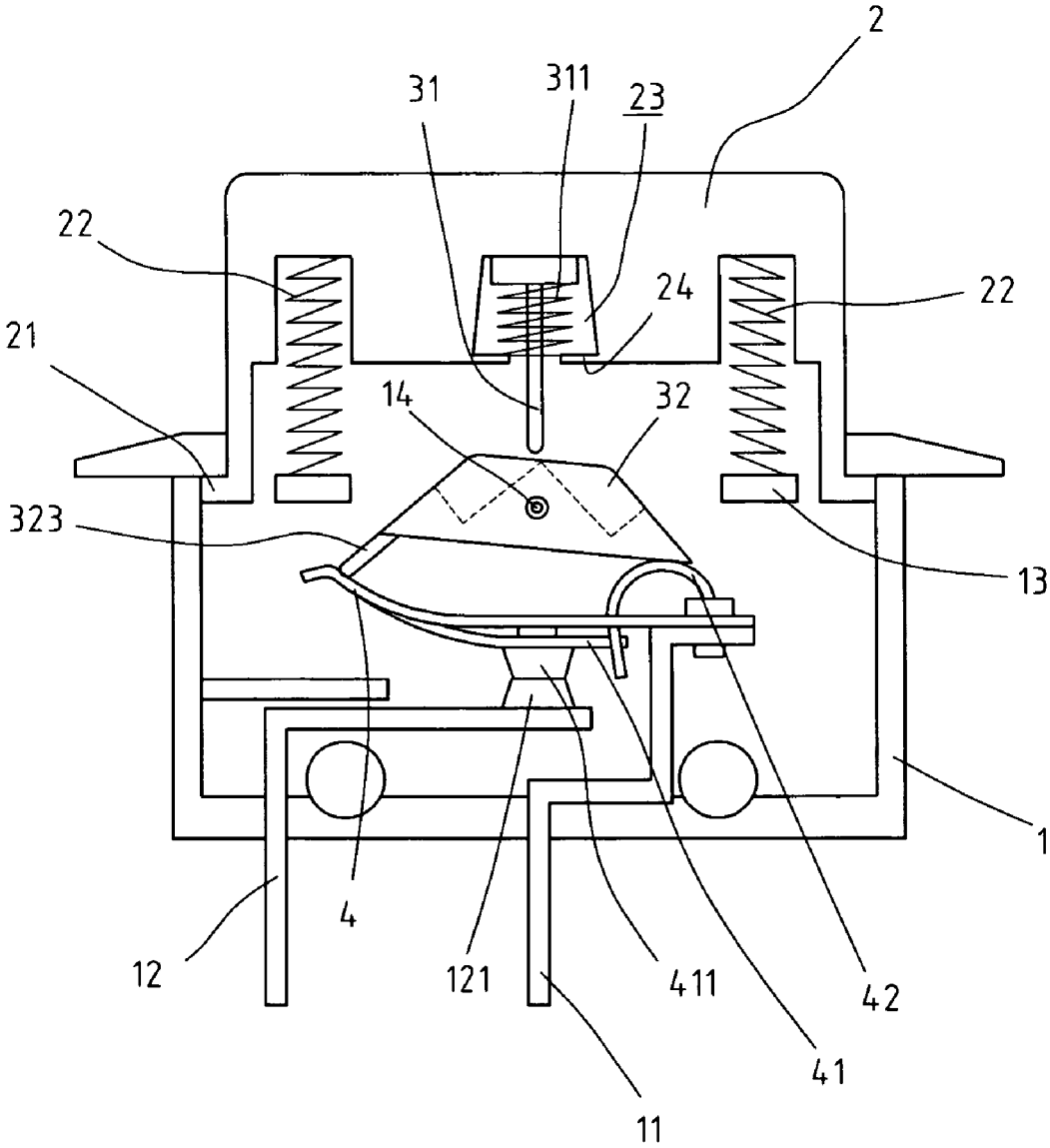
FIG. 3 shows that the switch member is moved upward when being released in "ON" status.

It is noted that there is a sufficient space for the action member 32 to move upward as shown in FIG. 3, so that when overloaded, the contact portion 41 is bent upward to separate the two contact points 411, 121 and the spring member 42 is moved upward to push the action member 32 upward. Because the switch member 2 is located at the upper position, the upward movement of the action member 32 is not stopped by the push rod 31. The deformation of the contact plate 4 is competed.

While we have shown and described the embodiment in accordance with the present invention, it should be clear to those skilled in the art that further embodiments may be made without departing from the scope of the present invention.

What is claimed is:

1. A switch comprising a body with a top opening and a switch member engaged with the top opening of the body, the switch member moved in a vertical direction relative to the body, a first terminal and a second terminal extending through a bottom of the body, at least one resilient member connected between an inside of the body and the switch member to maintain the switch member at an upper position;

a link mechanism having a push rod and an action member, a spring mounted to the push rod and a first end of the push rod movably engaged with the switch member, the action member pivotably connected to the body and having a left slope surface and a right slope surface, a second end of the push rod selectively contacting the two slop surfaces when the switch member is pushed, an extension extending inclinedly from a first end of the action member; wherein when the switch member is not pushed downward, the second end of the push rod does not contact the two slope surfaces, when the switch member is pushed downward, the second end of the push rod pushes either of the two slope surfaces to pivot the action member;

a contact plate being a curved flexible metal plate and having a first end fixed to the first terminal and a second end of the contact plate being a free end, a contact portion splits from the contact plate and a first contact point connected to an underside of the contact portion, a free end of the contact portion located above a top surface of the contact plate and connected with a free first end of a spring member, a second end of the spring member connected to the contact plate, a second contact point connected to the second terminal and located beneath the first contact point on the contact portion, the second end of the contact plate and the free end of the contact portion being deformed in opposite directions when being heated, the extension of the action member contacting the second end of the contact plate when the switch member is not pushed downward and the second end of the action member contacting the spring member, wherein when pushing the switch member to push the push rod to push the right slope surface, the second end of the action member is lowered to push the spring member and the free end of the contact portion downward so that the first and second contact points are in contact with each other to set the switch in "ON" status, when pushing the switch member to lower the push rod to push the left slope surface, the extension on the first end of the action member is lowered to push the second end of the contact plate downward so that the free end of the contact portion is bent upward to separate the first and second contact points to set the switch in "OFF" status, under overload, the contact portion is bent upward to separate the two contact points and the action member is freely moved upward.

2. The switch as claimed in claim 1, wherein at least one block extends from the inside of the body and the at least one resilient member has one end stopped on the at least one block and the other end of the at least one resilient member is engaged with the switch member.

3. The switch as claimed in claim 1, wherein the at least one resilient member is a helical spring.

4. The switch as claimed in claim 1, wherein the body has a pin extending from the inside thereof, the action member includes a hole through which the pin extends, a recess is defined in an underside of the switch member and two stop plates extend from two facing insides of the recess, the first end of the push rod includes a flange and is movably engaged with the recess, the spring has one end contacting the flange and the other end of the spring is rested on the two stop plates, the second end of the push rod extends out from the recess.

5. The switch as claimed in claim 1, wherein the spring is a helical spring.

6. The switch as claimed in claim 1, wherein the free end of the contact portion has a tongue and the free first end of the spring member has a first slot with which the tongue is engaged.

7. The switch as claimed in claim 1, wherein the second end of the spring member has a second slot and a ridge extends from an inner periphery of an opening from which the contact portion splits, the ridge is engaged with the second slot.

8. The switch as claimed in claim 1, wherein the spring member is a U-shaped member.

9. The switch as claimed in claim 1, wherein the contact plate is a bi-metallic plate.

* * * * *